US009139410B2

(12) United States Patent
Clüsserath et al.

(10) Patent No.: US 9,139,410 B2
(45) Date of Patent: Sep. 22, 2015

(54) PROCESSING MACHINE FOR BOTTLES OR SIMILAR CONTAINERS

(75) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 868 days.

(21) Appl. No.: 12/992,013

(22) PCT Filed: Apr. 29, 2009

(86) PCT No.: PCT/EP2009/003093
§ 371 (c)(1),
(2), (4) Date: Nov. 10, 2010

(87) PCT Pub. No.: WO2009/138167
PCT Pub. Date: Nov. 19, 2009

(65) Prior Publication Data

US 2011/0072761 A1 Mar. 31, 2011

(30) Foreign Application Priority Data

May 15, 2008 (DE) ..... 10 2008 023 776

(51) Int. Cl.
*B65B 61/00* (2006.01)
*B67C 3/22* (2006.01)
*B67C 7/00* (2006.01)

(52) U.S. Cl.
CPC . *B67C 3/22* (2013.01); *B67C 7/002* (2013.01); *B67C 7/0073* (2013.01)

(58) Field of Classification Search
CPC ..... B65B 5/103; B65B 1/04; B65B 21/00; B65B 43/42; B65G 2201/0244
USPC ..... 53/136.1, 426
See application file for complete search history.

(56) References Cited

U.S. PATENT DOCUMENTS

| | | | | |
|---|---|---|---|---|
| 1,992,329 | A | 2/1935 | Schmidt | |
| 2,591,739 | A | 4/1952 | Stewart | |
| 3,182,691 | A | 5/1965 | Vergobbi | |
| 4,514,966 | A * | 5/1985 | Konstantin | 53/585 |
| 4,519,186 | A * | 5/1985 | Winter et al. | 53/585 |
| 6,701,697 | B2 | 3/2004 | Savigny et al. | |
| 7,311,125 | B2 * | 12/2007 | Krulitsch | 141/149 |

FOREIGN PATENT DOCUMENTS

| | | |
|---|---|---|
| DE | 4104313 | 8/1992 |

* cited by examiner

*Primary Examiner* — Robert Long
(74) *Attorney, Agent, or Firm* — Occhiuti & Rohlicek LLP

(57) ABSTRACT

A processing machine for processing containers includes rollers arranged around a machine axis thereof. The rollers form a mounting arrangement. A rotor mounted with the mounting arrangement rotates about the machine axis. Processing stations are provided on the rotor. A functional element interacts with the rotor or the processing stations. The rollers are provided on a region of the mounting arrangement opposing the functional element such that they are movable. Some rollers are positioned such that the tangential points between the rotor and the functional elements do not become displaced in excess of a selected amount during thermal expansion.

14 Claims, 6 Drawing Sheets

PROCESSING MACHINE FOR BOTTLES OR SIMILAR CONTAINERS

CROSS-REFERENCE TO RELATED APPLICATIONS

This application is the National Stage of International Application No. PCT/EP2009/003093, filed on Apr. 29, 2009, which claims the benefit of German Application Serial No. 10 2008 023 776.0, filed on May 15, 2008, the contents of both of the foregoing applications are hereby incorporated by reference in their entirety.

The invention relates to a processing machine for bottles or similar containers, comprising at least one rotor which is mounted rotatable about a vertical machine axis and can be driven to circulate about said machine axis, and a plurality of processing stations provided on the rotor according to the preamble of claim 1.

Processing machines of this type are known in various embodiments, particularly also as filling machines, labelling machines, inspection machines and as rinsers. For the mounting of the rotor, ball bearing slewing rims are typically used, by means of which the rotor is rotatably mounted on the largest possible diameter to achieve, among other things, the required stability. A particular disadvantage thereof is that ball bearing slewing rims of this type are expensive and are often only available on the market with long delivery times.

It is an object of the invention to provide a container processing machine which can be realised at a significantly reduced cost with sufficient stability of the mounting of the circulating rotor. In order to achieve this aim, a processing machine is configured according to claim 1.

With the configuration according to the invention, expensive ball bearing slewing rims can be dispensed with. Nevertheless, the possibility exists of rotatably mounting the rotor on a large diameter relative to the outer diameter of the rotor and thereby to ensure the required stability of the rotor and the mounting arrangement for said rotor.

Developments, advantages and application possibilities of the invention are disclosed in the description of exemplary embodiments below and in the drawings. All the features described and/or illustrated are fundamentally part of the subject matter of the invention per se or in any combination, regardless of their bringing together in the claims or their back references. The content of the claims is also incorporated into the description.

The invention will now be described in greater detail based on exemplary embodiments, making reference to the drawings, in which.

Figure 1:
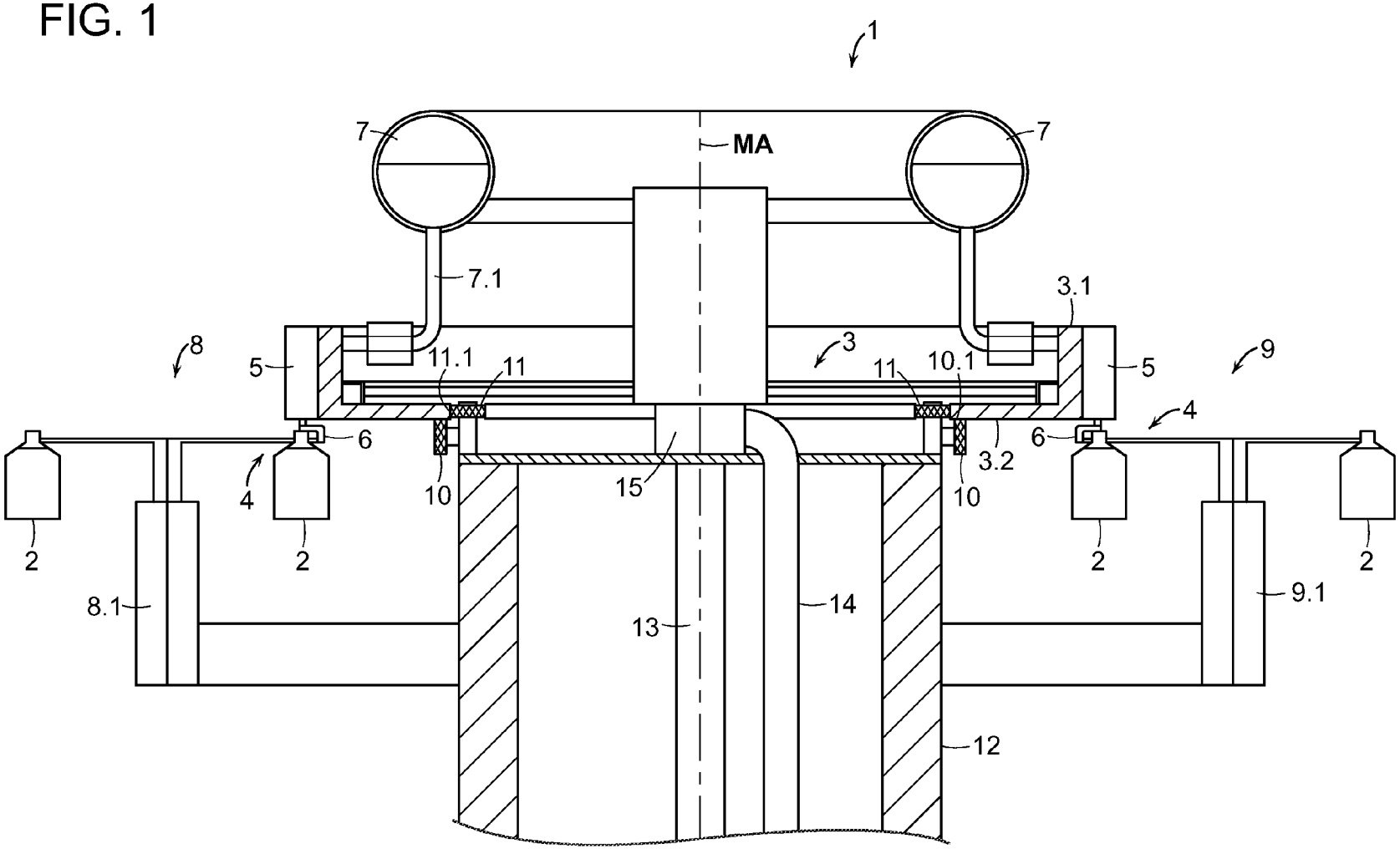
FIG. 1 shows, in a simplified form and in section, a container processing machine according to the invention in the form of a filling machine.

The container processing machine denoted in FIG. 1 in general with the reference sign 1 is configured as a filling machine for filling containers in the form of bottles 2 with a liquid filling material or product. For this purpose, the container processing machine 1 comprises a rotor 3 which is drivable to circulate (arrow A) about a vertical machine axis MA and is configured ring-shaped with a rotor section 3.1 and a rotor section 3.2 and, on the periphery thereof or on rotor section 3.1, filling stations 4 are provided, each comprising a filling element 5 and a container support 6 on which the bottles 2 are held suspended at an outlet flange with their bottle axis oriented vertically. Each filling element 5 is connected via a product line 7.1 to an annular tank 7 on the rotor 3. The bottles 2 to be filled are each fed to the filling stations 4 via a container inlet by a circulating star-wheel conveyor 8. The filled bottles 2 are removed from the filling stations 4 at a star-wheel conveyor 9 which constitutes the container outlet.

The peculiarity of the processing machine 1 lies therein that the rotor 3 is mounted on a relatively large diameter which, in this embodiment, corresponds to approximately 70% of the outer diameter of the rotor 3 at the section 3.1 which supports the filling elements 5, and this is achieved with the aid of rollers 10 and 11 at a stationary receptacle or at a stationary machine chassis 12 (that is, not circulating with the rotor 3) which are mounted freely rotatable. The two bearings 8.1 and 9.1 for the star-wheel conveyors 8 and 9 are also provided on the machine chassis 12.

The rollers 10 and 11 are preferably arranged distributed at equal angular spacings round the machine axis and in this embodiment, the rollers 10 are each freely rotatable about an axis oriented radially to the machine axis MA and the rollers 11 are each freely rotatable about axes parallel or approximately parallel to the machine axis MA.

The rollers 10, which act as a group and in their totality as an axial mounting for the rotor 3, each lie against a bearing surface or running surface 10.1, which is provided on the underside of the rotor or the annular rotor section 3.2, and encompasses the machine axis MA in annular manner and is arranged in the embodiment shown in a plane perpendicular to the machine axis MA. The rotor 3 therefore rests with the running surface 10.1 on the rollers 10.

The rotor 3 rests on the rollers 11 which act as a group and in their totality as a radial mounting and are arranged within the annular opening of the rotor 3, with a bearing surface or running surface 11.1 which is the inner annular surface formed on the rotor section 3.2 and concentrically encompasses the machine axis MA. The rollers 11 and 12 are each individual rollers, that is, rollers which are provided freely rotatable individually and spaced apart and are preferably adjustable, both in the vertical direction and radially to the machine axis MA.

In the exemplary embodiment shown, driving of the rotor 3 is carried out about the machine axis MA via a shaft 13 which is rotatingly driven by a drive system (not shown) of the container processing machine 1. The supply of product or filling material to the tank 7 is carried out via a line 14 and a rotary feedthrough 15.

The particular advantage of the container processing machine 1 lies therein that the rotor 3 is mounted both axially and radially on a relatively large diameter, while avoiding an expensive ball bearing slewing rim, specifically using an economical mounting arrangement of simple design which is formed by the rollers 10 and 11 and the associated bearing surfaces 10.1 and 11.1. The provision of the bearing surfaces 10.1 and 11.1 on the rotor 3 has the advantage that said rotor is usually already made as a rotary part and it is therefore possible, when manufacturing the rotor 3, simultaneously to manufacture the bearing surfaces 10.1 and 11.1 with the required precision.

With the described mounting of the rotor 3 with the rollers 10 and 11, it is possible in particularly advantageous manner to provide the rollers 11 fixed to the machine chassis 12 on a partial region of the mounting arrangement formed by the rollers 10 and 11, and outside this partial region, to provide the rollers 11 or bearings for the rollers movable on the machine chassis 12, for example, radially to the machine axis MA, specifically against the action of the positioning forces pressing the rollers 11 against the bearing surface 11.1. As a result, in the fixed partial region where the rollers 11 or their bearings are provided fixed to the machine chassis 12, very precise positioning of the rotor 3 and of the processing stations or filling stations 4 provided on the rotor, in relation to adjacent functional elements, for example, to the star-wheel conveyors 8 and 9 is ensured. The precise spatial allocation between the processing stations on the rotor and the outer functional elements, for example, the star-wheel conveyors 8 and 9 is of great significance, particularly in the case of containers or bottles 2 which are light-weight and/or are transported suspended, such as PET or plastics bottles, in order to ensure reliable operation of a processing or production line including the processing machine 1.

Figure 2:
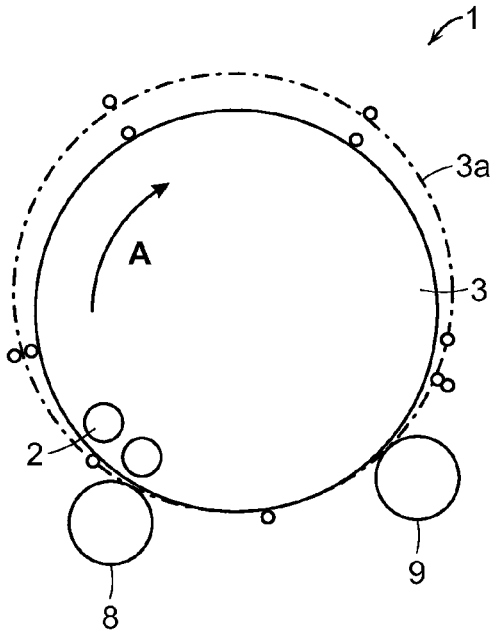
FIG. 2 shows, in a simplified functional representation, a plan view of the container processing machine according to FIG. 1.

The movable arrangement of the bearings of the rollers 11 outside the fixed partial region enables adjustment for changes to the rotor diameter, particularly also in the case of changes to the rotor diameter caused by thermal expansion, the changes which occur, for example, on hot filling of products and also on cleaning and/or sterilisation of the processing machine 1 with a hot cleaning or sterilising medium. This adjustment for temperature-related changes of the rotor diameter is carried out by radial displacement of the machine axis MA, as indicated in FIG. 2 with the broken line 3*a*. With this solution, it is therefore possible to maintain an exact spatial allocation at the transfer region between the respective star-wheel conveyor 8 or 9 and the processing or filling stations 4 at the rotor 3, specifically despite thermally-induced changes in the rotor diameter.

In order to ensure the spatial allocation of the star-wheel conveyors 8 and 9 in relation to the rotor 3, which is highly important for the fault-free functioning of the systems, it has proved to be particularly advantageous if rollers 11 which are fixed relative to the machine chassis are arranged such that the tangential points between the rotor 3 and the star-wheel conveyors 8 and 9 do not become displaced, or only to an acceptable extent, in the event that thermal expansion occurs. For this purpose, it is, for example, highly advantageous if the fixed rollers 11 are arranged at the tangential points or close thereto.

It has proved to be particularly advantageous if the displacement of the tangential points resulting from thermal expansion is less than 1 mm.

It should be understood that with this embodiment with partially fixed and partially movable rollers 11, the bearing surface 10.1 for the rollers 10 is configured such that the rotor 3 reliably rests with this bearing surface against the rollers 10 in every condition.

Figure 3:
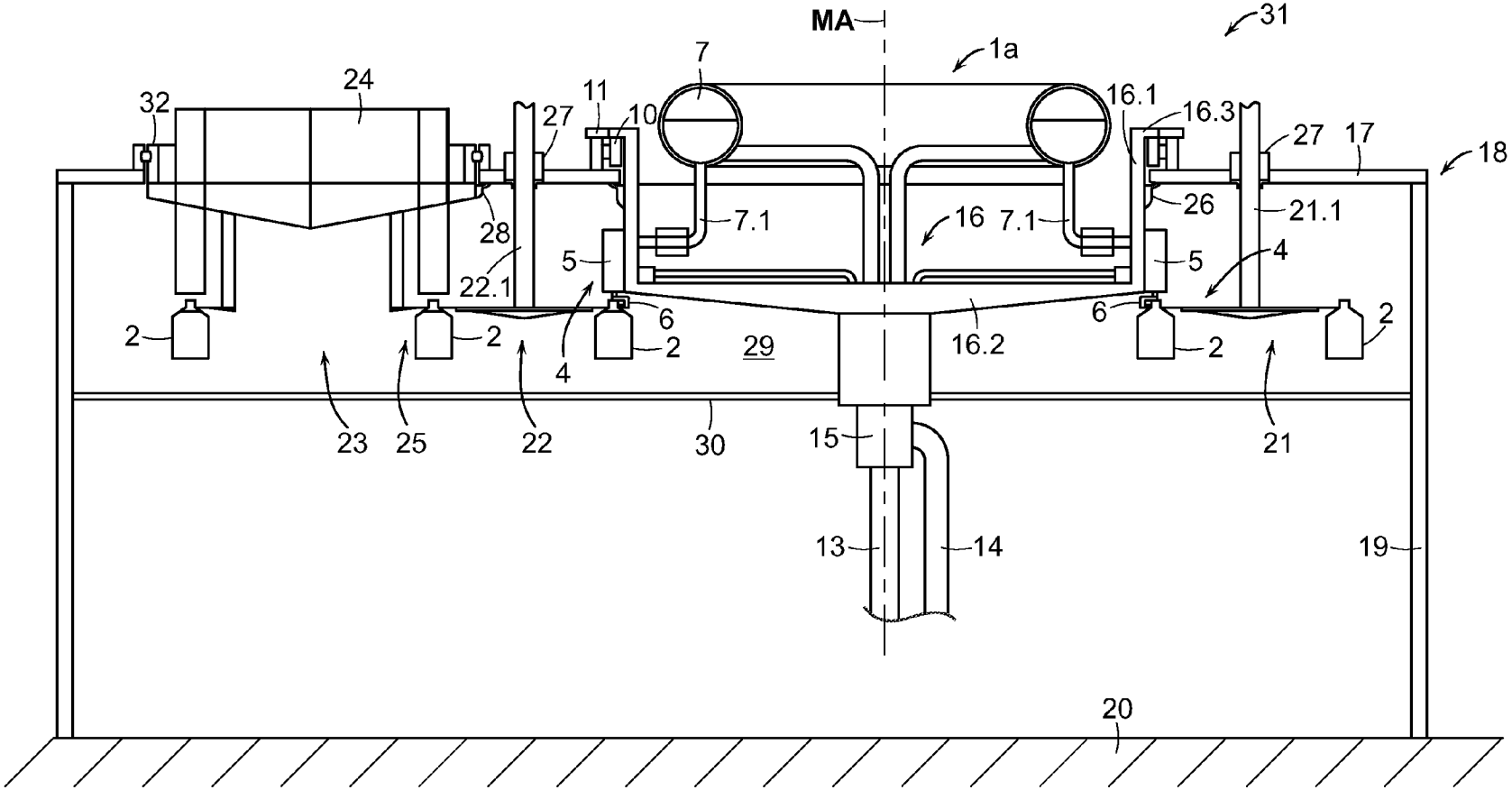
FIG. 3 shows, in a representation similar to FIG. 1, a container processing machine according to the invention in the form of a filling machine, together with a closing machine.

It has been assumed above that the rollers 10 and 11 are provided on the machine chassis 12. The possibility naturally also essentially exists, with corresponding configuration of the rotor 3 and of the machine chassis 12, of mounting the rollers 10 and/or 11 of both groups of rollers on the rotor 3 and to configure the associated bearing surfaces or running surfaces on the machine chassis 12. The possibility also exists of providing one group of rollers, for example, the rollers 10 on the machine chassis 12 and the other group of rollers, for example, the rollers 11 on the rotor 3. With these variants also, the bearings for the rollers 11 effecting the radial mounting can also be provided partially fixed and partially movable, specifically for the above-described adjustment for changes in the rotor diameter. FIG. 3 shows a processing machine 1*a* which is also configured as a filling machine and again comprises a plurality of processing stations and/or filling stations 4 each having a filling element 5 and a container support 6 at the periphery of a rotor 16 driveable to circulate about the vertical machine axis MA. The rotor 16 is mounted in suspended manner at an upper support plate 17 of a support frame 18 rotatable about the vertical machine axis MA, specifically once again with the rollers 10 and 11 arranged distributed round the machine axis MA. Said rollers are themselves mounted freely rotatable on the upper side of the support plate 17, specifically about axes radial to the machine axis MA (rollers 10) or about axes parallel to the machine axis MA (rollers 11). The described mounting of the rotor 16 causes said rotor to project at least with the portion thereof comprising the filling stations 4 through an aperture in the support plate 17 beyond the underside of said support plate. As a result of the configuration of the bearing surfaces or running surfaces 10.1 and 11.1 on the rotor portion 16.3 which projects in radial or flange-like manner beyond the rotor section 16.1, the rotor 16 is mounted with the mounting arrangement formed by the rollers 10 and 11 on a diameter which is greater than the outer diameter which the rotor 16 has at the rotor section 16.1 comprising the filling stations 4. The rotor 16 is configured similar to the rotor 3 with an annular rotor section 16.1 which concentrically encompasses the machine axis MA, on which the filling elements 5 are provided, and with a rotor section 16.2 extending radially to the machine axis MA. The rotor section 16.1 projects beyond the upper side of the rotor section 16.2. The tank 7 holding the filling material or product is arranged on the rotor 16 and is connected via product lines 7.1 to the filling elements 5.

The support frame 18 also comprises wall sections or a support chassis 19 with which the support plate 17 with the surface sides thereof arranged in horizontal planes is spaced apart from a base 20.

Figure 4:
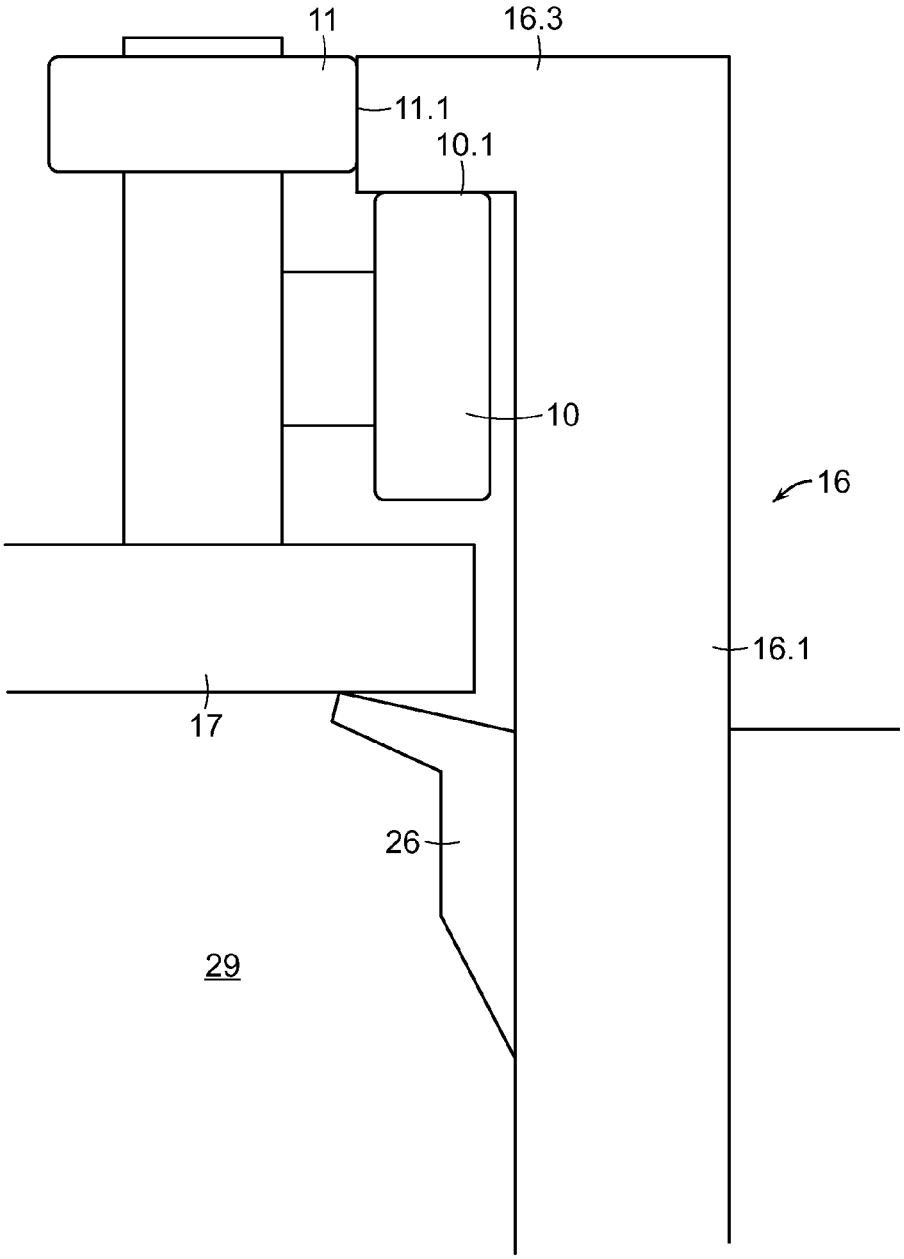
FIG. 4 shows, in an enlarged representation, one of the roller bearings of the filling machine of FIG. 2.

In the case of the processing machine 1*a*, the running surfaces and bearing surfaces 10.1 or 11.1 respectively which interact with the rollers 10 and 11 are formed, on an upper flange-like radially outwardly projecting rotor section 16.3 in which the rotor section 16.1 gives way to the upper side of the rotor 16. As shown, particularly, by FIG. 4, the underside of the rotor section 16.3 forms the bearing surface 10.1 and the outer cylindrical ring surface of the rotor section 10.3 which concentrically encompasses the machine axis MA, forms the bearing surface 11.1.

The bottles 2 to be filled are fed to the filling stations 4 via a star-wheel conveyor 21 forming the container inlet. The filled bottles 2 are removed from the filling stations 4 at a star-wheel conveyor 22 forming the container outlet of the processing machine 1*a* or are passed to a closing machine or rather to one of the closing stations 25 which are provided at a circulating rotor 24 of the closing machine 23.

The filling stations 4, the star-wheel conveyors 21 and 22 and the closing stations 25 and further transport elements for the bottles 2 which are not shown are respectively configured for suspended support or suspended transport of the bottles 2. Furthermore, the star-wheel conveyors 21 and 22 and the rotors 16 and 24 are held suspended on the support plate 17 such that the star-wheel conveyors 21 and 22, particularly also with the section thereof interacting with the bottles 2 and the filling and closing stations 4 and 25, are arranged beneath the support plate 17, whereas all the mounting and drive elements, including the rollers 10 and 11 are arranged above the support plate 17.

The junction between the support plate 17 and the rotor 16 is tightly closed by means of a seal 26. Corresponding seals 27 and 28 are also provided on shafts 21.1 and 22.1 of the star-wheel conveyors 21 and 22 and at the junction between the rotor 24 and the support plate 27.

The space beneath the rotors 16 and 24 and beneath the star-wheel conveyors 21 and 22 where the bottles 2 are situated is closed toward the outside in the embodiment shown, specifically on one side by the support plate 17 and by the rotors 16 and 24 filling the apertures in said support plate, as well as by the walls forming the support chassis 19 and an intermediate floor 30 which is provided parallel to the support plate 17 beneath the movement path of the bottles 2. The system 31 shown which comprises, inter alia, the container processing machine 1*a*, the closing machine 23 and the star-wheel conveyors 21 and 22 can therefore be used for sterile or aseptic filling of a product into the bottles 2 which are fed to said system 31 or the sterile space 29 via an inlet lock and, after filling and closing, are conducted out of the space 29 via an outlet lock.

Figure 5:
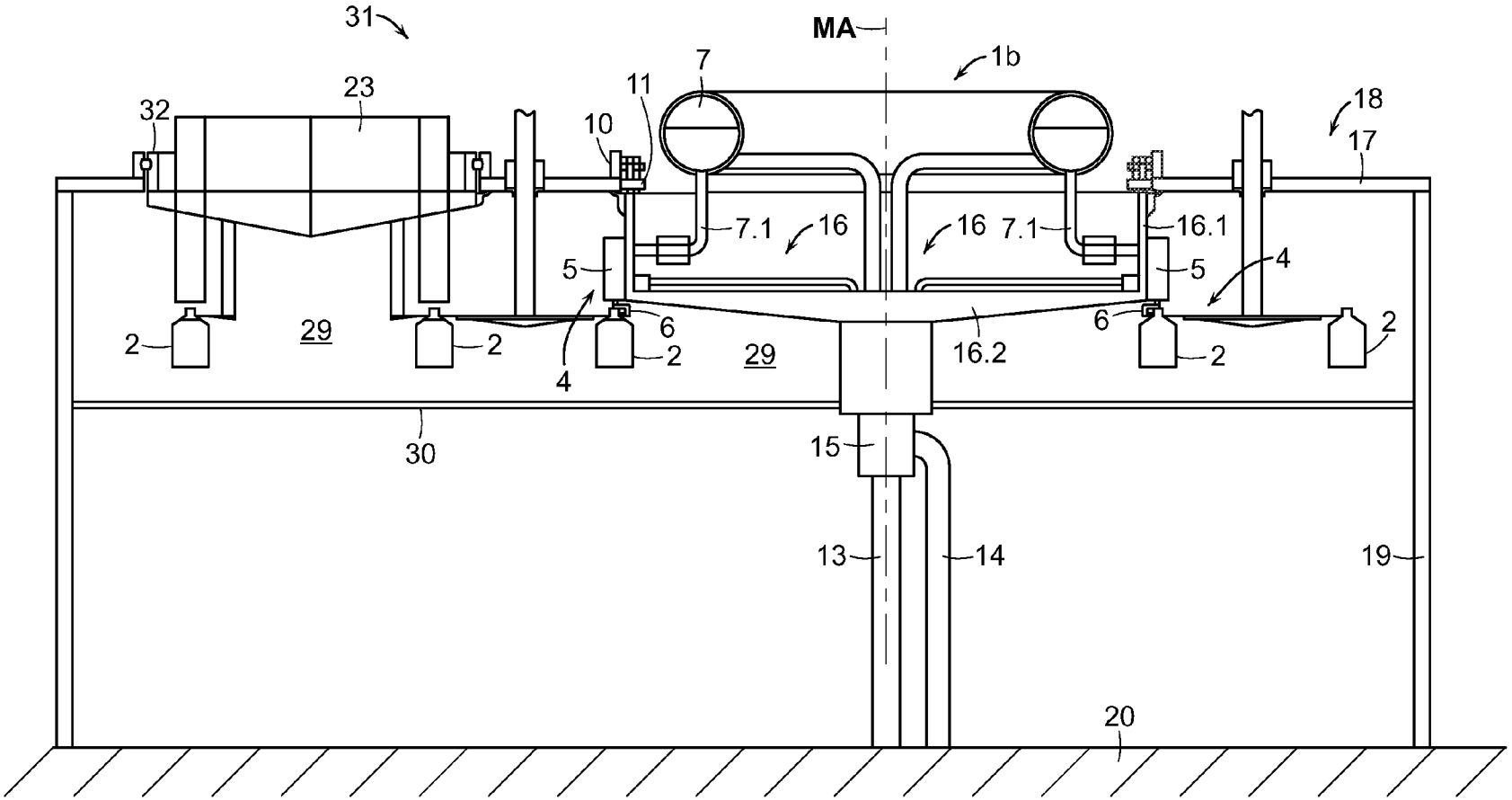
FIGS. 5 and 6 show representations similar to FIGS. 2 and 3 in another embodiment of the invention.
Figure 6:
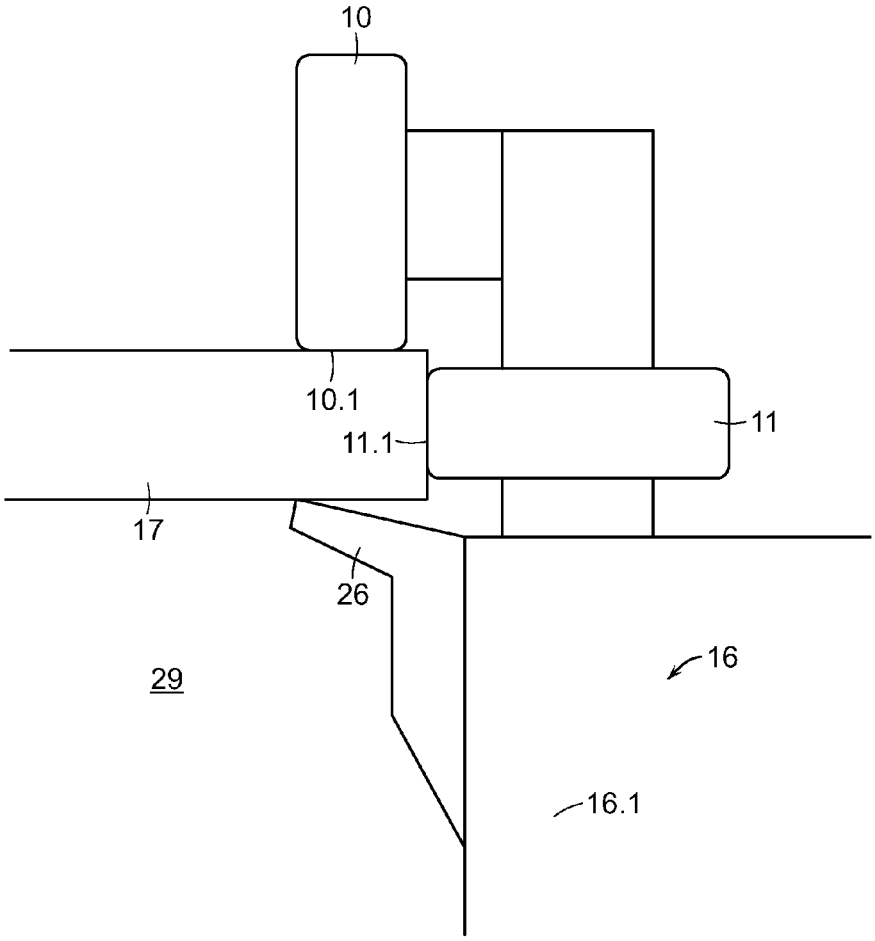

FIGS. 5 and 6 show, inter alia, a container processing machine 1*b* in the form of a filling machine, which itself is part of a system 31 for filling bottles with a filling material and for subsequent closing of said bottles. The processing machine 1*b* differs from the processing machine 1*a* only in that the rollers 10 and 11 constituting the suspended mounting of the rotor 16 are not provided on the support plate 17, but are freely rotatable on the upper end of the rotor section 16.1, specifically again such that all the rollers 10 and 11 are situated outside the space 19 formed beneath the support plate 17.

With the systems 31 shown in FIGS. 3 to 6, the rotor 24 of the closing machine 23 is rotatably mounted in each case with a ball bearing slewing rim 32. It should be understood that, in place of this mounting, a mounting arrangement also formed by the rollers 10 and 11 can be provided.

The invention has been described above by reference to exemplary embodiments. It should be understood that numerous amendments and variations are possible without departing from the inventive concept underlying the invention.

REFERENCE SIGNS

1,1*a*,1*b* Processing machine
2 Bottle
3 Rotor
3*a* Thermal deformation of rotor
3.1,3.2 Rotor section
4 Filling station
5 Filling element
6 Container support
7 Tank
7.1 Product line
8,9 Star-wheel conveyor
8.1,9.1 Bearing
10,11 Individual rollers
10.1,11.1 Bearing surface or running surface
12 Machine chassis
13 Shaft
14 Line
15 Rotary feedthrough
16 Rotor
16.1,16.2,16.3 Rotor section
17 Support plate
18 Support frame
19 Support chassis
20 Base
21,22 Star-wheel conveyor
21.1,22.1 Shaft
23 Closing machine
24 Rotor
25 Closing station
26,27,28 Seal
29 Space
30 Intermediate floor
31 System
32 Ball bearing slewing rim
A Direction of rotation of rotor 3 or 16
MA Machine axis

The invention claimed is:

1. A processing machine for processing containers, said processing machine comprising a machine chassis, a plurality of rollers arranged around a machine axis of said processing machine, said rollers forming at least one mounting arrangement, at least one rotor mounted with the at least one mounting arrangement to be rotatable about the machine axis, and a plurality of processing stations provided on the rotor, at least one functional element interacting with the rotor or with the processing stations, and wherein at least the rollers are provided on a region of the mounting arrangement opposing said functional element such that said rollers are movable, wherein said rollers comprise a first set of rollers that comprises first rollers and a second set of rollers that comprises second rollers, wherein each roller belongs to at most one of said first and second sets, wherein said first rollers are disposed in a first region of said mounting arrangement, wherein said second rollers are disposed outside said first region, wherein said first rollers are fixed relative to said chassis, wherein, unlike said first rollers, said second rollers are movable relative to said chassis, wherein, as a result of being movable relative to said chassis, said second rollers are able to move in response to a displacement of said machine axis that results from a change in a diameter of said rotor, wherein said change in diameter of said rotor is a result of thermal expansion of said rotor, wherein, as a result of being fixed to said machine chassis, said first rollers remain fixed when a change in a diameter of said rotor causes a displacement of said machine axis, wherein said rotor and said at least one functional element contact each other at a tangent point, wherein said tangent point is at a first location prior to thermal expansion of said rotor, wherein, as a result of thermal expansion of said rotor, said tangent point moves to a second location that is separated from said first location by a distance that is greater than zero, and wherein, as a result of said first rollers remaining fixed, said distance is less than an extent of thermal expansion of said rotor.

2. The processing machine according to claim 1, wherein at least some rollers are provided on a machine element that does not circulate with the rotor, wherein said machine element interacts with a surface on the rotor, wherein said surface encompasses said machine axis, and wherein said surface is selected from the group consisting of a bearing surface and a running surface.

3. The processing machine according to claim 1, wherein at least some of the rollers are adjustably and/or movably arranged at least in one spatial axis and/or spatial plane.

4. The processing machine according to claim 1, wherein the rollers are mounted to be freely rotatable.

5. The processing machine according to claim 1, wherein said distance is less than 1 mm.

6. The processing machine according to claim 1, wherein wherein at least one of said first rollers is arranged at said tangent point.

7. The processing machine according to claim 1, wherein the rotor is supported on the machine chassis by said mounting arrangement.

8. The processing machine according to claim 1, wherein the rollers comprise: a first group of rollers, and a second group of rollers, wherein the rollers of the first group serve for axial or substantially axial mounting of the rotor, and wherein the rollers of the second group serve for radial or substantially radial mounting of the rotor.

9. The processing machine according to claim 1, wherein the rotor is mounted by the mounting arrangement formed by the rollers on a diameter that corresponds to at least 50% of the outer diameter of the rotor.

10. The processing machine according to claim 9, wherein the rotor is mounted by the mounting arrangement formed by the rollers on a diameter that is greater than the diameter of the rotor in the region of the processing stations.

11. The processing machine according to claim 1, said processing machine being configured as one of: a filling machine, a rinser, a labeling machine, and an inspection machine.

12. The processing machine according to claim 1, wherein the rollers comprise rollers that are movable along an axis radial to the machine axis.

13. The processing machine according to claim 7, wherein the rotor is suspended on the machine element.

14. The processing machine according to claim 1, wherein the rotor is mounted by the mounting arrangement formed by the rollers on a diameter that corresponds to at least 65% of the outer diameter of the rotor.

* * * * *